US006748688B2

(12) United States Patent
Matara

(10) Patent No.: US 6,748,688 B2
(45) Date of Patent: Jun. 15, 2004

(54) HOUSING FOR MOUNTING A COLLECTOR PLATE

(76) Inventor: John L. Matara, P.O. Box 6482, Big Bear Lake, CA (US) 92315

( * ) Notice: Subject to any disclaimer, the term of this patent is extended or adjusted under 35 U.S.C. 154(b) by 2 days.

(21) Appl. No.: 10/193,087

(22) Filed: Jul. 9, 2002

(65) Prior Publication Data

US 2004/0006905 A1 Jan. 15, 2004

(51) Int. Cl.[7] ..... A47G 1/06

(52) U.S. Cl. ..... 40/794; 40/800; 248/468; 248/488; 248/603; 248/604; 428/913.3

(58) Field of Search ..... 40/743, 777, 792, 40/794, 800, 658; 248/603, 604, 617, 468, 488, 346.04; 428/913.3

(56) References Cited

U.S. PATENT DOCUMENTS 3,740,016 A * 6/1973 Buescher ..... 248/488
4,106,742 A * 8/1978 Miller et al. ..... 248/488
4,368,585 A * 1/1983 Meltzer et al. ..... 40/790
4,457,484 A * 7/1984 Hameister ..... 248/490
4,473,207 A * 9/1984 Nascher ..... 248/488
D306,528 S * 3/1990 Worley ..... D6/309
6,182,938 B1 * 2/2001 Wright ..... 248/468

* cited by examiner

*Primary Examiner*—Gary Hoge
(74) *Attorney, Agent, or Firm*—Knobbe, Martens, Olson & Bear

(57) ABSTRACT

A housing for mounting a collector plate comprises, in a preferred embodiment, a base with at least one concave recess, a plurality of clamps disposed about the periphery of the recess and an opening in a rear surface of the base. In a preferred embodiment, the clamps have plate-engaging surfaces which are biased toward the recess such as by springs.

20 Claims, 3 Drawing Sheets

HOUSING FOR MOUNTING A COLLECTOR PLATE

BACKGROUND OF THE INVENTION

1. Field of the Invention

The invention relates in general to the field of housings for mounting objects, and more specifically to a housing for mounting one or more collector plates.

2. Description of the Related Art

Collector plates are popular items for collectors and hobbyists. These collectors plates often comprise dinner plates with a picture, design, etc commemorating a person or event printed on a concave front side. Thus, these plates are generally displayed by placing them on shelves, or racks such that the front surface is visible. Information about the artist or the pictured person or event is often printed on the rear side of the plate, so it is also often desirable that the rear side of the plate also remain visible. Thus it is desirable to have a housing for holding a collector plate which may be used to mount a variety of plates without substantially obscuring the decorative features of the plates.

SUMMARY OF THE INVENTION

Thus, in one preferred embodiment, an apparatus for mounting at least one plate is provided. The apparatus includes a housing having at least one concave recess and at least one hole at a periphery of the recess having at least one clamp disposed therein. The clamp preferably comprises a longitudinal rod having a first end, a central portion and a second end, in which the second end is bent to form an acute angle relative to the central portion, and is configured to engage a plate. There is also a cap engaged on the first end of the rod and a spring disposed along the rod between the cap and the second end of the rod.

In one embodiment, a housing for mounting at least one collector plate is provided. The housing includes a base having at least one concave recess configured to receive a collector plate and securement means to removably secure the plate to the base, wherein the securement means a plurality of clamps, a securement plate, and/or one or more securement straps.

In one embodiment, there is provided a clamp for mounting a plate to a housing. The clamp comprises a longitudinal rod having a first end, a second end and a central portion, wherein the second end is bent to form an acute angle relative to the central portion thereby being configured to engage a plate. There is also a cap engaged on the first end of the rod and a spring disposed along the rod between the nut and the second end of the rod.

In one embodiment, a housing for mounting a collector plate comprises a base with at least one concave recess, a plurality of clamps disposed about the periphery of the recess and an opening in a rear surface of the base. The clamps have plate-engaging surfaces which are biased toward the recess by springs. The clamps also have caps for disengaging the clamps as desired.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the present invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Having thus summarized the general nature of the invention, certain preferred embodiments and modifications thereof will become apparent to those skilled in the art from the detailed description herein having reference to the figures that follow, of which.

DETAILED DESCRIPTION OF THE PREFERRED EMBODIMENTS

Figure 1:
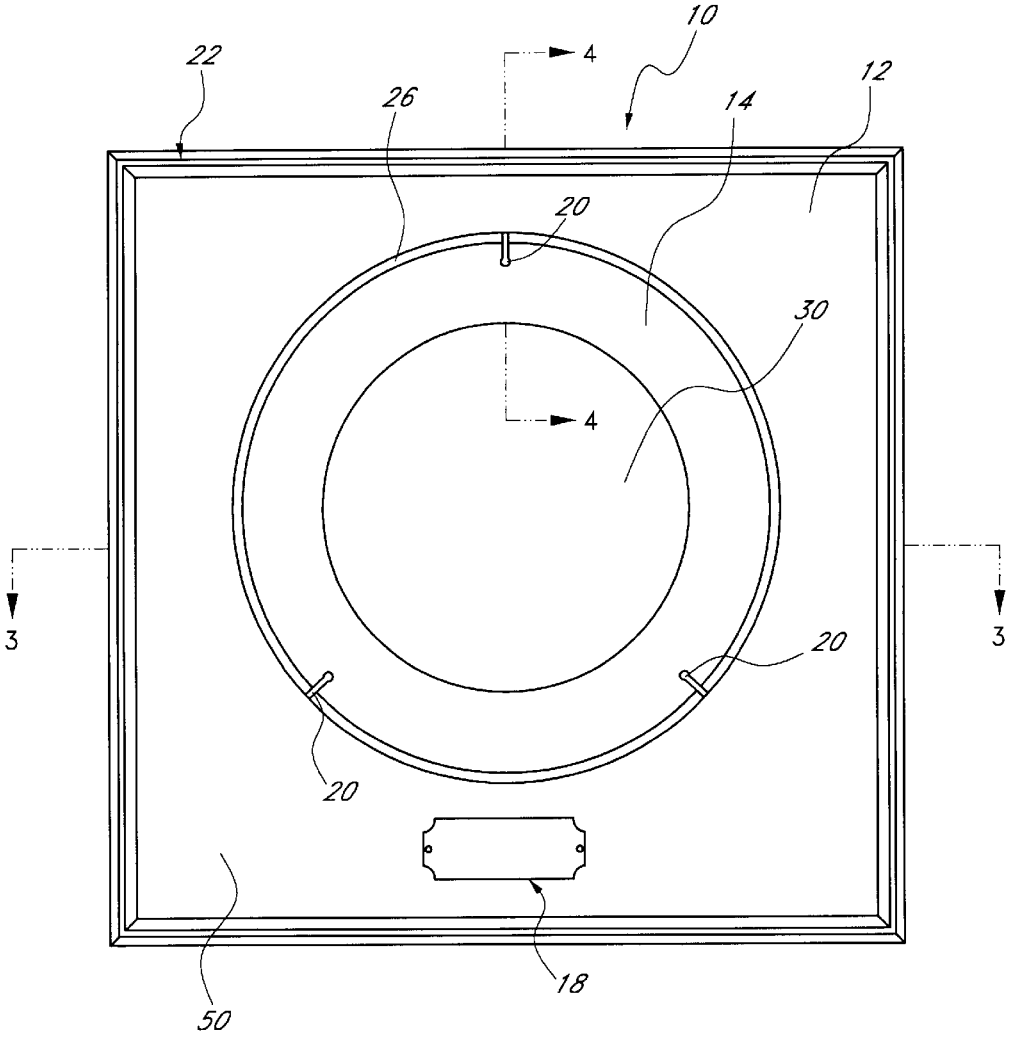
FIG. 1 is a plan view of a front surface of one preferred embodiment of a collector plate mounting housing.

FIGS. 1–4 illustrate an embodiment of a collector plate housing 10 having desirable features and advantages. The housing 10 generally includes a base 12 with a recess 14 configured to receive a plate. The housing 10 also includes a plurality of clamps 20 configured to hold the plate, and disposed about the periphery of the recess. Optionally, the housing may be provided with a nameplate 18 on the display surface. Housings may also include additional recesses such that more than one plate may be displayed in a single housing. The term "collector plate" as used herein is a broad term used to refer to plates or dishes having a decorative pattern or design placed on at least the front surface thereof. Collector plates are generally round in shape, but they may also be oval, square, or any other shape.

Figure 2:
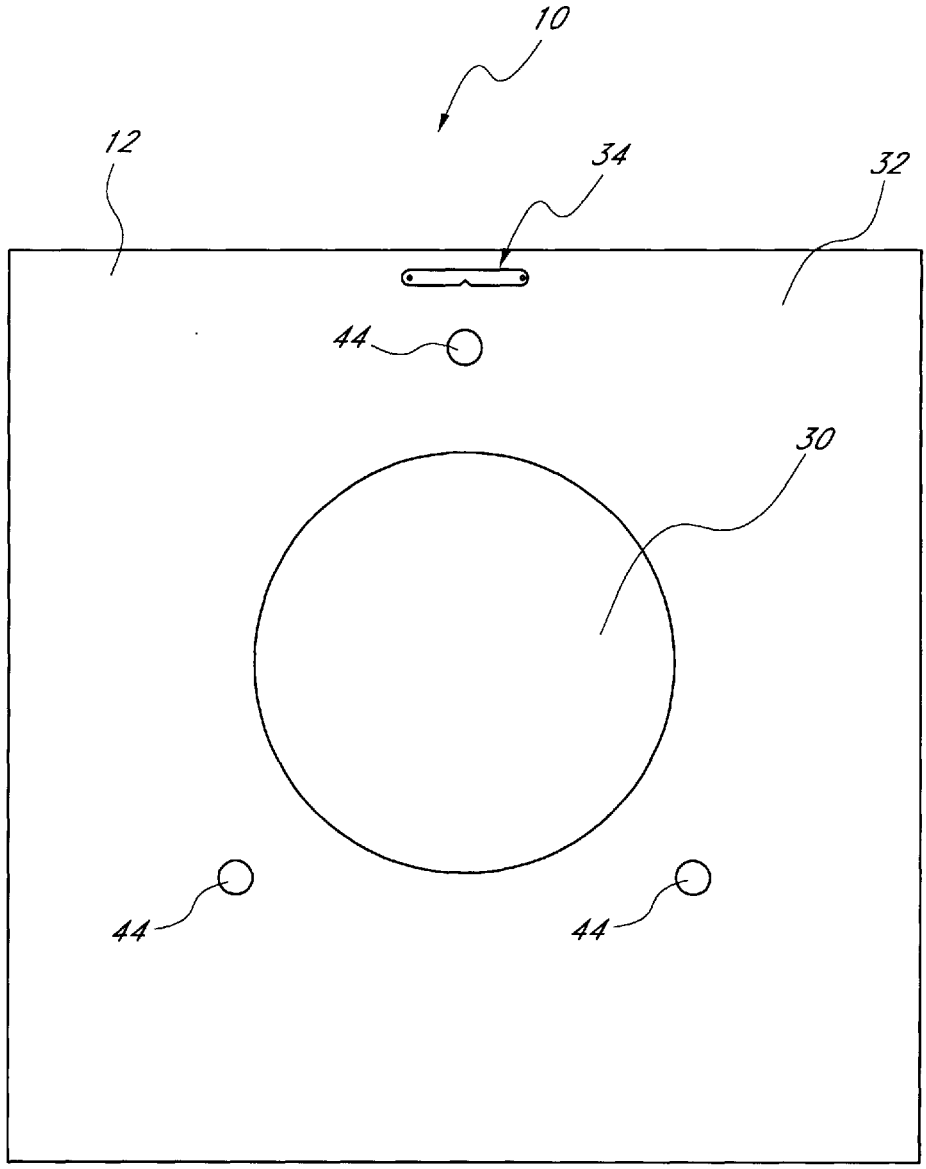
FIG. 2 is a plan view of a rear surface of the housing of FIG. 1.

The base 12 shown in FIGS. 1 and 2 is substantially rectangular, however circular, elliptical, or otherwise shaped housings 10 may also be used as desired. There are really no limits to the shapes that a housing may take on, provided that it be able to accommodate a plate. For example, housings may take on the shape of familiar objects, such as a musical instrument or a house, or characters or people, such as Mickey Mouse or Elvis Presley. In one particular embodiment, in a housing for mounting an eight-inch nominal diameter plate, the base comprises a rectangular shape with a width of about 12+/−1 inches and a height of about 12+/−1 inches. Of course, as will be apparent to those skilled in the art in view of the present disclosure, a housing such as that shown and described herein may be differently sized to accommodate larger or smaller plates or to have more or less housing material surrounding the plate. In some embodiments a range of sizes may be supported in a single housing by providing differently sized or shaped clamps 20. The base 12 may comprise a decorative outer edge 22 such as that shown in FIGS. 3 and 4. Those skilled in the art will recognize, of course, that any edge detail may be used as desired, or that the edges may be plain, without added detail.

The front surface 50 may also have surface patterning, wherein a design is carved into the front surface 50 or raised on the surface as in a relief. Such patterning may also be done on a securing panel, as discussed below, placed over some or all of the front surface 50. The shape, color, surface patterning, material, and other decorative features of the housing 10 may be chosen so as to embody a particular theme consistent with or complementary to the design of the plate(s) placed in the housing 10.

The base 12 is typically made of wood, preferably a hardwood such as oak. Alternatively, of course, the base 12 may be made from any desired material recognized as suitable, such as particle board, oriented strand board (OSB), plastic, metal, composites, glass, etc., and combinations of such materials. The base material may optionally be covered with a veneer, laminate, stain, or paint/pigment layer as desired. When the base 12 is made of wood or other toolable material, the curves and other shaped surfaces may be made using woodworking techniques, such as those known in the art, utilizing routers, saws, and the like. When the base 12 is made of plastic or other moldable material, it may be injection molded to the desired shape and size.

The recess 14 shown in FIG. 1 is generally sized and configured to receive a substantially circular plate. Alternatively of course, the recess may be configured to receive a substantially elliptical, rectangular, or otherwise shaped plates as desired. In one embodiment, best seen in FIG. 4, the recess 14 comprises a substantially arcuate concave surface 24 for supporting an arcuate convex surface of a plate. The recess of FIG. 4 also includes a horizontal portion 26. The horizontal portion 26 provides a visual border around the plate to provide an aesthetic appearance as well as providing a horizontal surface through which the clamp 20 may extend. In an alternative embodiment, the horizontal portion 26 may be omitted. In preferred embodiments, the plate is inlaid into the recess 14 such that the plate is substantially within the recess 14, this includes, but is not limited to, where the upper edge of the outer rim of the plate lies within or below the plane of the horizontal portion 26, if present, or the front surface 50 of the housing 10.

Figure 3:
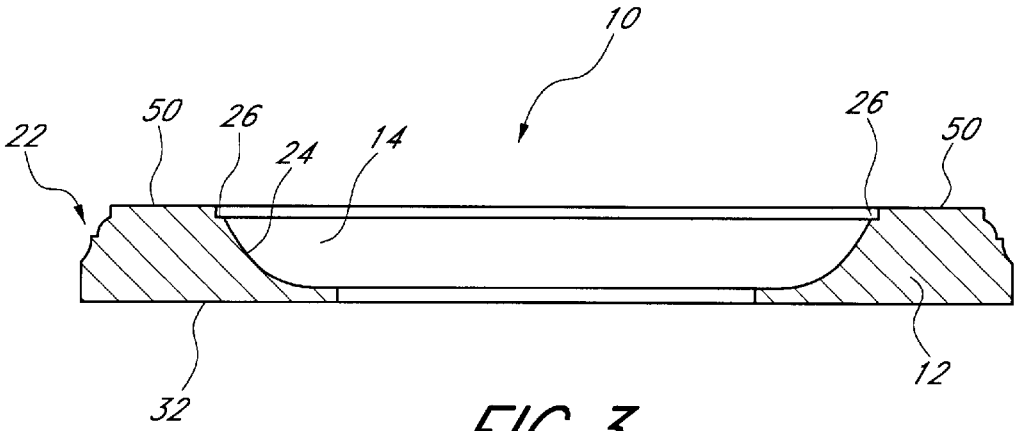
FIG. 3 is a section view of the housing of FIG. 1 taken through line 3—3.

As seen in FIGS. 2 and 3, the base may comprise an opening 30 in a rear surface 32 sized and positioned to allow information on a rear surface 32 of a plate to be visible. The opening 30 of FIG. 2 is shown to be a circular opening 30 which shares a center with the plate, however the opening 30 may be any shape and at any position such that information on the rear of a plate mounted to the housing 10 is visible.

The housing 10 may be provided with features for allowing the housing to be hung from a fastener mounted to a vertical wall. Such features may include a bracket 34 such as the one shown in FIG. 2, or any other suitable feature such as hooks, eyes, wires, screws etc. Alternatively, features for mounting the housing on a wall may comprise one or more recesses formed in the rear surface 32 of the base 12, the recesses being configured to receive a fastener such as a nail or a screw, etc. Alternatively still, the housing may be provided with a support for standing the housing upright on a horizontal surface, such as a shelf or a table. In other embodiments, the housing is configured to be placed on a tripod, or to be suspended as an ornament.

Figure 4:
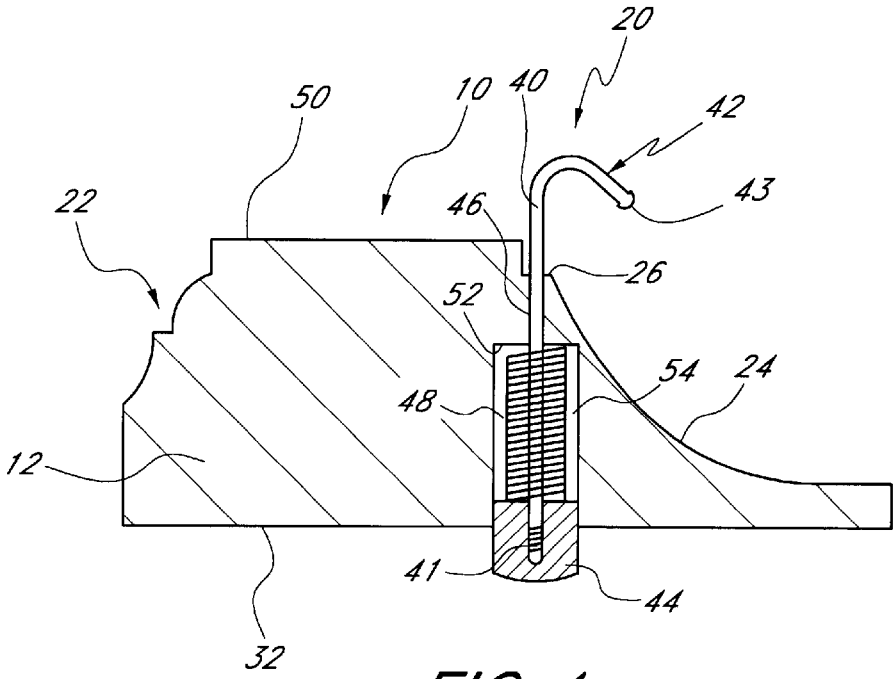
FIG. 4 is a section view of the housing of FIG. 1 taken through line 4—4, showing a clamp suitable for retaining a collector plate on the housing.

The housing 10 generally comprises at least one clamp 20 configured to hold the plate to the base 12. One possible embodiment of a clamp 20 is shown in FIG. 4. According to this embodiment, the clamp 20 generally comprises a longitudinal rod 40 with a first, threaded end 41 and a second, bent end 42. The threaded end 41 is configured to receive a cap 44 such as a cap nut, a lock nut, or any other device which will engage the first end 41 of the rod 40. In one embodiment, the first rod end 41 does not include threads, and a cap 44 is retained on the first rod end by friction, adhesives, or any other suitable method. The rod 40 extends through a hole 46 in the base 12 such that the bent portion 42 extends above the front surface 50 of the housing 10 at a periphery of the recess 14.

The illustrated clamp 20 also includes a spring 48 disposed between the cap 44 and a shoulder 52 formed by a counter-bore 54 in the base 12. The spring 48 is generally sufficiently resilient that a plate will be rigidly held by the housing, but not so excessively resilient that a clamp may crack or damage the plate. The spring 48 may be a coil spring as shown, or the spring may comprise any resilient biasing mechanism as desired.

The second end 42 of the rod 40 generally comprises a bend which forms an acute angle relative to the central portion of the rod 40. The bent portion 42 is generally configured to engage a front surface of a collector plate in order to support the plate. The length and/or angle of bend of the bent portion 42 may be varied in order to accommodate larger or smaller plates. The tip 43 of the second end 42 may be substantially rounded in order to substantially prevent damage to the plate caused by the clamp 20. In order to further protect a plate, the clamp rod second end 42 may be covered by a plastic or rubber sheath.

The rod from which the clamps are made may be any suitable material or cross-sectional shape. For example, in one embodiment a circular brass rod is be used for a clamp. Alternatively, the rod may comprise any other metal or plastic rod having a rectangular, triangular, or any other cross-sectional shape as desired.

In alternate embodiments, the clamps can take any of a number of different forms suitable to achieve the objective of securely and, preferably, removably fixing the plate to the housing. Preferred clamps have at least one surface that contacts the upper (decorated) surface of the plate and applies a force to hold the plate securely to the base. Although preferred embodiments utilize biasing clamps, other embodiments may utilize non-biasing clamps such as those which use screwing mechanisms or snap-fit elements to provide the securing force. In such other non-biasing embodiments, care should be taken so as to not place undue force on the plate such as may cause it to break or crack.

In another alternative embodiment, the housing comprises a securing panel is used in addition to or in lieu of the clamps. If present, a securing panel is placed over at least a portion of the front surface 50 and engages at least the outer rim of the plate placed in the recess 14 of the housing. A securing panel preferably covers as little of the plate as possible while still providing for effective securement of the plate within the housing. The securing panel may be attached to the rest of the housing by any permanent, semi-permanent or removable securement means, including glue, nails, screws, clamps, straps, brackets, and the like.

In yet another embodiment, the securement of the plate to the housing is done by means of one or more securement straps placed across the surface of the plate. The securement straps may be made of any thin, elongate material, including wire, fishing line, string, or the like. Fishing line (or a similar substantially transparent, strong polymeric material) is an especially preferred material because its presence will not substantially interfere with the ability to view the decorative surface of the plate. The securement straps preferably extend through the front surface 50 on one or both ends and are secured on the rear surface 32 of the housing 10. In an alternate embodiment, a single piece of strapping material may be used to cross the outer surface of the plate multiple times, and may even extend around the entire plate. For example, a housing 10 could have three holes surrounding the recess 14 at 120° from each other with a single piece of strapping being secured on the rear surface 32 near a first hole, extending through the housing 10 and across a portion of the plate to an adjoining hole, where it is threaded back to the back and across the rear surface 32 to the third hole where it is threaded through the third hole to the front surface and across the front of the plate to the first hole where it is threaded into the hole and secured again in the back of the housing 10. Alternatively, the securement straps may be secured on the front surface 50.

The clamps may be provided in any number or arrangement found to be suitable for the particular plate to be housed. For example, FIG. 1 shows three clamps positioned about a circular recess at about 0°, 135° and 225°. Other clamp configurations may be desirable for differently shaped plates.

The counter-bore 54 typically has a diameter such that the cap 44 may fit therein. The size of the cap 44 may, of course vary as desired by the user. As discussed further below, the cap 44 is preferably sized to be engaged by a user to press the cap 44 to disengage the clamp 20. The hole 26 in the base 12 is typically sized to receive the rod such that the rod is axially and rotatably movable therein.

In use, the clamps 20 are operated by pressing cap 44 towards the base 12, and into the counter-bore 54, thereby raising the second end 42 of the clamp rod 40 away from the front surface 50 of the housing 10. Once the tip 43 of the second end 42 is at a sufficient height above the front surface, the rod 40 may be rotated such that the tip 43 is above the front surface 50 of the base 12. Once a sufficient number of clamps 20 have been turned, a plate may be placed therein, and the clamps may be turned such that the tips 43 engage a front surface 50 of the plate, thereby securing the plate to the housing.

Although certain preferred embodiments and examples have been described herein, it will be understood by those skilled in the art that the present inventive subject matter extends beyond the specifically disclosed embodiments to other alternative embodiments and/or uses of the invention and obvious modifications and equivalents thereof. Thus, it is intended that the scope of the present inventive subject matter herein disclosed should not be limited by the particular disclosed embodiments described above, but should be determined only by a fair reading of the claims that follow.

What is claimed is:

1. An apparatus for mounting at least one plate, the apparatus comprising:

a housing having at least one concave recess and at least one hole at a periphery of the recess;

at least one clamp disposed in the at least one hole, the clamp comprising:

a longitudinal rod having a first end, a central portion and a second end, the second end being bent to form an acute angle relative to the central portion, and being configured to engage a plate;

a cap engaged on the first end of the rod;

a spring disposed along the rod between the cap and the second end of the rod.

2. The apparatus of claim 1, wherein the at least one hole comprises a counter-bore.

3. The apparatus of claim 2, wherein the clamp extends through the at least one hole such that the spring and the cap are received in the counter-bore.

4. The apparatus of claim 1, wherein the recess comprises a curved surface configured to conform to a curve of a plate.

5. The apparatus of claim 1, comprising at least three clamps disposed in at least three holes.

6. The apparatus of claim 1, further comprising a bracket configured to support the housing on a fastener secured to a vertical wall.

7. A housing for mounting at least one collector plate, the housing comprising:

a base having at least one concave recess configured to receive a collector plate; and at least one securement device to removably secure the plate to the base; wherein the securement device comprises a plurality of clamps, wherein each of the clamps comprises a longitudinal rod having a first end, a second end a central portion, the second end being bent to form an acute angle relative to the central portion thereby being configured to engage a plate.

8. The housing of claim 7, wherein a plate placed within the recess lies substantially within the recess.

9. The housing of claim 7, wherein each of the clamps further comprises a cap engaged on the first end of the rod.

10. The housing of claim 9, wherein each of the clamps further comprises a spring disposed along the rod between the cap and the second end of the rod.

11. The housing of claim 10, wherein the housing comprises at least three clamps.

12. The housing of claim 7, wherein each of the clamps comprises a longitudinal member having a first portion and a second portion, the second portion being bent to form an acute angle relative to the first portion thereby being configured to engage a plate, wherein the clamps removably fix a plate to the housing using a non-biased force.

13. The housing of claim 7, wherein the base comprises a substantially rectangular perimeter.

14. The housing of claim 7, wherein the recess comprises a substantially circular perimeter.

15. The housing of claim 7, wherein the recess comprises a substantially arcuate concave surface configured to receive a substantially arcuate convex surface of a plate.

16. The housing of claim 7, wherein the recess comprises a curved surface contoured to receive a plate.

17. A clamp for mounting a plate to a housing, the clamp comprising:

a longitudinal rod having a first end, a second end and a central portion, the second end being bent to form an acute angle relative to the central portion thereby being configured to engage a plate;

a cap engaged on the first end of the rod;

a spring disposed along the rod between the cap and the second end of the rod.

18. The clamp of claim 17, wherein the second end of the rod comprises a substantially rounded tip.

19. The clamp of claim 18, wherein the cap is threadably engaged on the rod.

20. The clamp of claim 19, wherein the clamp is configured to hold a collector plate on a housing.

* * * * *